US005549851A

United States Patent [19]

Fukushima et al.

[11] Patent Number: 5,549,851

[45] Date of Patent: Aug. 27, 1996

[54] CONDUCTIVE POLYMER COMPOSITION

[75] Inventors: Motoo Fukushima; Mikio Aramata; Shigeru Mori, all of Kawasaki, Japan

[73] Assignee: Shin-Etsu Chemical Co., Ltd., Tokyo, Japan

[21] Appl. No.: 377,342

[22] Filed: Jan. 24, 1995

[30] Foreign Application Priority Data

Jan. 25, 1994 [JP] Japan ..... 6-023135

[51] Int. Cl.[6] ..... H01B 1/20; H01B 1/12; H01B 1/04; H01B 1/24

[52] U.S. Cl. ..... 252/519; 252/500

[58] Field of Search ..... 252/500, 518, 252/519; 524/254, 251, 252, 255, 257, 435, 431

[56] References Cited

U.S. PATENT DOCUMENTS

| | | | |
|---|---|---|---|
| 4,439,507 | 3/1984 | Pan et al. | 430/59 |
| 4,471,041 | 9/1984 | Baranyi et al. | 430/59 |
| 4,609,602 | 9/1986 | Ong et al. | 430/58 |
| 4,983,482 | 1/1991 | Ong et al. | 252/500 X |
| 5,213,923 | 5/1993 | Yokoyama et al. | 430/58 |
| 5,236,798 | 8/1993 | Aoike et al. | 430/66 |
| 5,258,252 | 11/1993 | Sakai et al. | 430/66 |
| 5,272,029 | 12/1993 | Sakai et al. | 430/58 |
| 5,336,798 | 8/1994 | Fukushima et al. | 556/430 |
| 5,358,987 | 10/1994 | Kanai et al. | 524/254 |
| 5,407,987 | 4/1995 | Fukushima et al. | 252/500 X |
| 5,447,824 | 9/1995 | Mutsaers et al. | 252/500 X |
| 5,482,655 | 1/1996 | Vogel et al. | 252/500 |

FOREIGN PATENT DOCUMENTS

| | | |
|---|---|---|
| 3235958 | 10/1991 | Japan . |
| 4330079 | 11/1992 | Japan . |
| 6138681 | 5/1994 | Japan . |

*Primary Examiner*—Douglas J. McGinty
*Attorney, Agent, or Firm*—Millen, White, Zelane, & Branigan, P.C.

[57] ABSTRACT

A silicon containing polymer such as a polysilane, poly-(disilanylenephenylene), and poly(disilanyleneethynylene) is admixed with an amine compound and then doped with an oxidizing dopant, typically iodine and ferric chloride, to produce a highly conductive polymer composition having improved shapability. The composition is easily applicable, as by spin coating, to form a highly conductive film or coating.

11 Claims, No Drawings

CONDUCTIVE POLYMER COMPOSITION

BACKGROUND OF THE INVENTION

1. Field of the Invention

This invention relates to a highly electroconductive polymer composition having shapability.

2. Prior Art

Conductive organic polymers have attracted great attention since the recent discovery that doping polyacetylene with electron acceptor or donor substances gives rise to a charge transfer formation reaction to develop high electric conduction based on electron conduction. Typical examples of the conductive organic polymer are polyacetylene, polyphenylene, polypyrrole, poly(phenylenevinylene), polyaniline, and polythiophene.

These polymers, however, are difficult to shape because they are insoluble and infusible. Films are formed by gas phase polymerization or electrolytic polymerization but the shape of such films is limited by the shape of the reactor or electrode. The films tend to be seriously degraded upon doping. These problems form a bar to be cleared prior to commercial use.

Polysilane is a very interesting polymer from the aspects of the metallic nature and electron delocalization of silicon as compared with carbon, high heat resistance, flexibility, and good thin film-forming ability. Few polysilanes are known to be conductive. An example of a conductive polysilane known to us is a doped polysilastyrene using as a dopant fluorine compounds such as $SbF_5$ and $AsF_5$, but the dopants are highly toxic and cumbersome to handle. See R. West et. al., J. Am. Chem. Soc., 103, 7352 (1981).

It is desirable to dope with dopants which are safe and easy to handle, for example, iodine and ferric chloride. However, highly conductive polymers which are acceptable for practical use are not available at present.

SUMMARY OF THE INVENTION

An object of the present invention is to provide a conductive polymer composition which is easy to shape and which is rendered conductive by doping with oxidizing dopants such as iodine and ferric chloride.

We have found that a silicon containing polymer in admixture with an amine compound is soluble in solvents, shapable to any desired configuration of film or coating, and can be doped with oxidizing dopants so as to be highly conductive. After doping, the silicon containing polymer maintains flexibility without embrittlment. A highly conductive polymer is thus obtained. Then a composition comprising a doped silicon containing polymer in admixture with an amine compound, from which a highly conductive film or coating which is easily shapable can be formed, is a useful stock material which can be widely used in electric, electronic and communication fields since it may find use in battery electrodes, solar battery and electromagnetic shield casings and the like.

Briefly stated, the present invention provides a conductive polymer composition comprising a silicon containing polymer in admixture with an amine compound wherein the silicon containing polymer is doped with an oxidizing dopant.

DETAILED DESCRIPTION OF THE INVENTION

The conductive polymer composition of the invention is defined as comprising a silicon containing polymer in admixture with an amine compound wherein the silicon containing polymer is doped with an oxidizing dopant.

Preferably the silicon containing polymer has a Si—Si bond in its backbone or a Si— Si bond and a C—C multiple bond (double bond or triple bond) in its backbone. More preferably the silicon containing polymer is a polysilane, a poly(disilanylenephenylene) or a poly(disilanyleneethynylene).

Typically the polysilane is represented by the general formula (1) or (2) and the poly(disilanylenephenylene) and poly(disilanyleneethynylene) are represented by the general formula (3).

$$(R^1R^2Si)_n \quad (1)$$

$$(R^1R^2Si)_n(R^3R^4Si)_m \quad (2)$$

$$[(R^1R^2Si)—A—(R^3R^4Si)]_m \quad (3)$$

In the formulae, $R^1$ to $R^4$ are independently a hydrogen atom or a substituted or unsubstituted monovalent hydrocarbon group having 1 to 14 carbon atoms, especially 1 to 10 carbon atoms. Exemplary hydrocarbon groups are alkyl groups such as methyl, ethyl, propyl and hexyl, aryl groups such as phenyl, substituted aryl groups such as alkyl-substituted phenyl, and cycloalkyl groups such as cyclohexyl. $R^1$ to $R^4$ may be identical or different. A is an ortho- , meta- or para-substituted phenylene group ($—C_6H_4—$), an acetylene group ($—C\equiv C—$), or a linkage of a plurality of such groups (e.g., $—C\equiv C—C_6H_4—C\equiv C—$). Letter n is an integer of at least 2, preferably 10 to 1,000,000, more preferably 50 to 500,000, and m is an integer of at least 1, preferably 1 to 1,000,000, more preferably 50 to 500,000.

The silicon containing polymer preferably has a number average molecular weight of 300 to 30,000,000, especially 1,500 to 1,500,000.

It will be understood that the silicon containing polymer can be easily synthesized by any well-known method, for example, Wurtz type condensation reaction of a corresponding dichlorosilane with an alkali metal.

The amine compound is preferably of the following general formula (4) or (5).

$$NR^5R^6R^7 \quad (4)$$

$$R^8R^9N—R^{10}—NR^{11}R^{12} \quad (5)$$

In the formulae, $R^5$ to $R^9$, $R^{11}$, and $R^{12}$ are independently a hydrogen atom or a monovalent organic group having 1 to 24 carbon atoms, especially 1 to 20 carbon atoms. Exemplary organic hydrocarbon groups are substituted or unsubstituted monovalent hydrocarbon groups including alkyl groups such as methyl, ethyl, propyl and hexyl, aryl groups such as phenyl, substituted aryl groups such as alkyl-substituted phenyl, aralkyl groups such as benzyl and phenethyl and cycloalkyl groups such as cyclohexyl and substituted or unsubstituted monovalent hydrocarbon groups having a $=N—N=$ group interposed therein such as amino-substituted hydrazone compounds. $R^5$ to $R^9$, $R^{11}$, and $R^{12}$ may be identical or different. $R^{10}$ is a divalent hydrocarbon group having 1 to 24 carbon atoms, especially 1 to 20 carbon atoms. Exemplary divalent hydrocarbon groups are alkylene and cycloalkylene groups having 1 to 8 carbon atoms, especially 1 to 6 carbon atoms such as methylene and ethylene, arylene groups having 6 to 12 carbon atoms such as phenylene, alkylene or cycloalkylene groups having an arylene group interposed therein, and arylene group having an alkylene or cycloalkylene group interposed therein.

Tertiary amines are preferred among the amine compounds since they are well miscible with the silicon containing polymer. Also useful are amines having an aromatic ring, for example, triphenyl amine, aryl amines, amino-substituted vinyl compounds, and amino-substituted hydrazone compounds which are represented by the following formulae.

Aryl amines

PDA

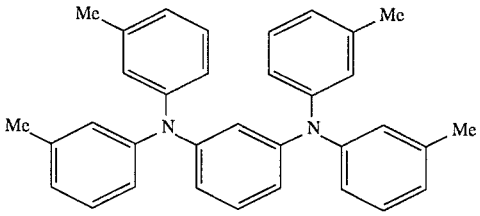

TPD

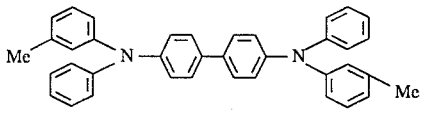

TPAC

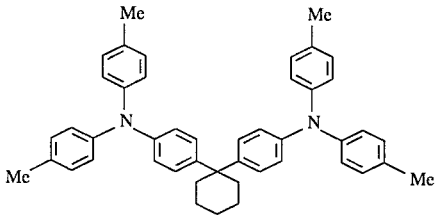

Amino-substituted vinyl compound

ST

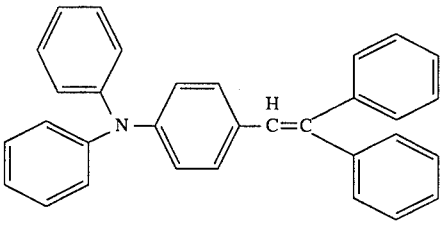

Amino-substituted hydrazone compound

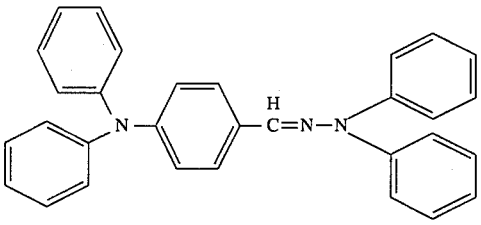

Desirably the amount of the amine compound blended in the composition, which varies with the type of amine compound and the type of silicon containing polymer, is such that about 1 to 200 parts by weight, especially about 5 to 100 parts by weight of the amine compound is present per 100 parts by weight of the silicon containing polymer. Outside this range, less amounts of the amine would be insufficient to aid an improvement in conductivity by doping whereas larger amounts of the amine would provide a negative function of aggravating film forming ability rather than an increase of conductivity.

The silicon containing polymer and the amine compound are admixed by blending them together followed by mechanical kneading. Where more uniform mixing is desired, they may be dissolved in a co-solvent, the solutions are mixed together, and a desired form is then obtained while evaporating the solvent. Where it is desired to manufacture a conductive material in the form of a thin film, a spin coating technique is preferred wherein the mix solution is applied to a substrate rotating at a high speed. Examples of the solvent include aromatic hydrocarbon solvents such as benzene, toluene and xylene and ether solvents such as tetrahydrofuran and dibutyl ether.

It is also effective that after the silicon containing polymer and the amine compound are mixed together, the mixture is allowed to stand for a while in a dry atmosphere or allowed to stand at a temperature of about 40° to 60° C. for aging or ripening purposes. In one typical practice, the silicon containing polymer is mixed with the amine compound, allowed to stand at room temperature for about 3 to 20 days, and then doped with an oxidizing dopant so as to improve conductivity. The aging time is reduced by increasing the temperature although temperatures above 150° C. are undesirable because the polymer can be degraded.

According to the present invention, the silicon containing polymer having the amine compound admixed therewith as mentioned above is doped with an oxidizing dopant so as to improve conductivity. It is known in the art that the silicon containing polymer is generally an insulating material as such and can be converted into a conductive polymer by doping with iodine, sulfuric acid, and fluorine compounds such as $SbF_5$ and $AsF_5$. With this conventional means, the polymer can be made conductive, but to a less satisfactory extent. We have found that there can be obtained a polymer composition, the silicon containing polymer in admixture with the amine compound doped with an oxidizing dopant, having high conductivity in a stable manner. It should be noted that polysilanes having amine compounds blended therewith have been reported, with hole mobility being measured (see M. Yokoyama et al., J.C.S., Chem. Comm., 1990, 802 and M. Stolka et al., Synth. Metal., 54 (1), 417). These reports, however, refer nowhere to an improvement in conductivity by doping with the oxidizing dopant.

The oxidizing dopant is used for rendering conductive the silicon containing polymer having the amine compound added thereto. Examples of the oxidizing dopant which can be used herein include halogens such as chlorine, bromine and iodine, transition metal chlorides such as tin chloride and ferric chloride, and Lewis acids such as antimony pentafluoride and arsenic pentafluoride. Preferred are safe and easy-to-handle dopants such as iodine and ferric chloride. The silicon containing polymer is doped with the oxidizing dopant by (1) a gas phase or dry doping technique of exposing the polymer to an atmosphere of dopant vapor, (2) a wet doping technique of immersing the polymer in a solution of the dopant in an inert solvent, or (3) a co-doping technique wherein provided that the polymer is soluble in a solution of the dopant, the resulting solution is applied and dried to shape a film or coating while doping takes place simultaneously.

Inert solvents are used in the wet doping technique (2) and (3). These solvents should be inert in a sense that they do not react with the dopant such as iodine and ferric chloride to lose its ability as an electron acceptor. That is, the solvents should not deactivate the dopant. Exemplary inert solvents include hydrocarbon solvents such as hexane, octane cyclohexane; aromatic solvents such as toluene, xylene and nitrobenzene; ethers such as ether and tetrahydrofuran; aprotic polar solvents such as dimethylformamide, dimethylsulfoxide, and hexamethylphosphoric triamide; nitromethane, acetonitrile, etc. Among others, such solvents as tetrahydrofuran are preferred especially for use in the co-doping technique because the silicon containing polymer is well soluble therein. This technique involves dissolving the silicon containing polymer in a solution of the dopant, casting the solution, and drying the coating to produce a doped conductor. The coating is preferably dried at a temperature of 0° to 150° C. under atmospheric or reduced pressure.

However, the wet techniques have a possibility that the polymer be gelled or decomposed due to degradation by the dopant. If such inconvenience should be avoided, the gas phase doping technique (1) is especially useful because it affords high conductivity through easy operation without a need for solvent.

The gas phase doping is able to control a doping rate by controlling the temperature and dopant partial pressure of the dopant atmosphere. In general, a temperature of −30° C. to 200° C. is employed. Lower temperature would retard the doping process whereas higher temperatures would cause deterioration of the doped polymer. The partial pressure of the dopant is preferably in the range of from 0.001 mmHg to 3800 mmHg. Lower partial pressures would retard doping whereas higher pressures would no longer increase the doping rate. In the case of iodine dopant, prompt doping takes place at room temperature and atmospheric pressure. In the case of ferric chloride dopant, the doping conditions are different from those of iodine because the vapor pressure is lower. Doping with ferric chloride is preferably effected at a temperature of 50 to 300° C. Lower temperature would retard the doping process whereas higher temperatures would cause deterioration of the doped polymer. Additionally doping is preferably carried out in a pressure of 0.001 mmHg to 760 mmHg. Lower pressures are not economical because it takes a long time until the pressure is reached. Higher pressures would result in a very slow doping rate because ferric chloride has a boiling point of 319° C. at atmospheric pressure. More preferably the partial pressure of ferric chloride dopant should range from 0.1 to 10 mmHg for the purpose of effectively increasing the conductivity of the polymer while doing should be effected at a temperature in the range of 50° to 200° C. This technique permits a conductive polymer to be manufactured by a very simple procedure using a least toxic ferric chloride without a need for flammable solvent.

EXAMPLE

Examples of the present invention are given below by way of illustration and not by way of limitation. Parts are by weight.

Conductivity was measured by vapor depositing platinum on a glass plate to form four terminals thereon to constitute an electrode and spin coating a solution of a polymer in a solvent on the glass plate to form a thin film to constitute a sample for conductivity measurement. With the sample light shielded and sealed, the sample was contacted with iodine or ferric chloride. A change of DC resistance with time was tracked. Conductivity was calculated from the resistance value which reached a steady state at room temperature (25° C.).

Synthesis 1

Preparation of polysilane and poly(disilanylenephenylene)

Metallic sodium was added to toluene in a nitrogen stream. With high speed stirring, the mixture was heated to 120° C. to achieve dispersion. With stirring, a dichlorodiorganosilane or bis(chlorodialkylsilyl)benzene was slowly added dropwise to the dispersion. The silicon compound was added that 2 to 3 mol of metallic sodium was available per mol of the silicon compound. The reaction solution was agitated for 4 hours until the reagents disappeared or reaction was complete. Then the reaction solution was allowed to cool. With the salt filtered off, the solution was concentrated to yield polysilane or poly(disilanylenephenylene).

Example 1

In 100 parts of toluene was dissolved 10 parts of each of the silicon containing polymers shown in Table 1 together with their number average molecular weight (Mn). The polymer solution was mixed with 3 parts of triphenylamine. Onto an electrode in the form of a glass plate having four terminals of platinum deposited thereon, the polymer solution was spin coated. The coating was dried at 50° C./2 mmHg, obtaining a thin film of about 1 μm thick serving as a sample for conductivity measurement. Immediately after film formation, the film was rested on a support within a dry brown glass bottle which was charged with solid iodine at the bottom. With the bottle sealed, the film allowed to stand in the co-presence of iodine. Conductivity was calculated from the resistance value obtained when a steady condition was reached. For comparison purposes, amine-free polymer films were also measured for conductivity. The results are shown in Table 1.

TABLE 1

| Silicon containing polymer | Mn | Appearance | Conductivity (S/cm) | Comparative Conductivity* (S/cm) |
|---|---|---|---|---|
| $\left[\begin{array}{c}C_6H_5\\ \mid\\ Si\\ \mid\\ CH_3\end{array}\right]_n$ | 11,000 | transparent | $6 \times 10^{-5}$ | $1 \times 10^{-6}$ |
| $\left[\begin{array}{c}C_6H_{17}\\ \mid\\ Si\\ \mid\\ C_6H_{17}\end{array}\right]_n$ | 340,000 | opaque | $1 \times 10^{-3}$ | $4 \times 10^{-7}$ |
| $\left[\begin{array}{c}C_6H_5\\ \mid\\ Si\\ \mid\\ CH_3\end{array}-C_6H_4-\begin{array}{c}C_6H_5\\ \mid\\ Si\\ \mid\\ CH_3\end{array}\right]_n$ | 13,000 | transparent | $5 \times 10^{-3}$ | $1 \times 10^{-6}$ |
| $\left[\begin{array}{c}C_6H_5\\ \mid\\ Si\\ \mid\\ CH_3\end{array}-C\equiv C-\begin{array}{c}C_6H_5\\ \mid\\ Si\\ \mid\\ CH_3\end{array}\right]_n$ | 100,000 | transparent | $1 \times 10^{-3}$ | $1.5 \times 10^{-8}$ |
| $\left[\begin{array}{c}C_6H_5\\ \mid\\ Si\\ \mid\\ CH_3\end{array}-C\equiv C-C_6H_4-C\equiv C-\begin{array}{c}C_6H_5\\ \mid\\ Si\\ \mid\\ CH_3\end{array}\right]_n$ | 3,600 | transparent | $2 \times 10^{-4}$ | $5.6 \times 10^{-5}$ |

*conductivity of amine - free polymer films

Example 2

Polymer films were prepared as in Example 1 using phenylmethylpolysilane as the silicon containing polymer. It was examined how conductivity changed when the amount of triphenylamine added and the duration between film formation and doping were changed. The amount of triphenyl-amine added is expressed in parts by weight per 100 parts by weight of the polymer. The doping stage was immediately after film formation (0) or 7 days after film formation. For comparison purposes, the conductivity of amine-free polymer films were also measured.

The results are shown in Table 2.

TABLE 2

| Amount of amine (pbw) | Appearance | Doping stage | Conductivity (S/cm) | Comparative Conductivity* (S/cm) |
|---|---|---|---|---|
| 1 | transparent | 0 | $1.3 \times 10^{-6}$ | $1.0 \times 10^{-6}$ |
| 5 | transparent | 0 | $2 \times 10^{-6}$ | — |
| 10 | transparent | 0 | $9 \times 10^{-6}$ | — |
| 15 | transparent | 0 | $5 \times 10^{-5}$ | — |
| 30 | transparent | 0 | $6 \times 10^{-5}$ | — |
| 50 | opaque | 0 | $6 \times 10^{-5}$ | — |
| 70 | opaque | 0 | $1.5 \times 10^{-4}$ | — |
| 30 | transparent | 7 days | $2 \times 10^{-4}$ | — |

*conductivity of amine-free polymer films

Example 3

100 parts of phenylmethylpolysilane was mixed with 30 parts of each of the amines shown in Table 3 and then dissolved in toluene. The polymer solution was spin coated to form a film which was immediately thereafter doped with iodine. A conductivity behavior was examined as in Example 1. The results are shown in Table 3.

TABLE 3

| Amine | Appearance | Conductivity (S/cm) |
|---|---|---|
| none | transparent | $1 \times 10^{-6}$(Control) |
| triphenylamine | transparent | $6 \times 10^{-5}$ |
| N, N-dimethylaniline | transparent | $4 \times 10^{-6}$ |
| N-phenylpyrrole | transparent | $2 \times 10^{-5}$ |
| N-ethylcarbazole | transparent | $6 \times 10^{-6}$ |
| N, N, N', N'-tetra-methylphenylenediamine | transparent | $1 \times 10^{-4}$ |
| tributylamine | transparent | $5 \times 10^{-5}$ |
| tris(bromophenyl)amine | transparent | $7 \times 10^{-5}$ |
| PDA | transparent | $3 \times 10^{-4}$ |
| ST | transparent | $4 \times 10^{-4}$ |
| N, N'-diphenyl-phenylenediamine | opaque | $2 \times 10^{-5}$ (conductivity unstable) |
| triethylenetetramine | opaque | $2 \times 10^{-6}$ (conductivity unstable) |

Example 4

100 parts of phenylmethylpolysilane was mixed with 30 parts of triphenylamine and then dissolved in toluene. The polymer solution was spin coated to form a film. The film was rested on a support within a dry brown glass bottle which was charged with solid ferric chloride at the bottom. With the bottle sealed, the film was allowed to stand in the co-presence of ferric chloride. The bottle was connected to a vacuum pump and evacuated to a vacuum of 4 mmHg. In this condition, the ferric chloride at the bottom was heated by means of a mantle heater. During the process, the color of sample for the conductivity measurement changed from transparency to black brown color while its conductivity rapidly increased. Eventually the conductivity reached a steady value and then the sample reached a temperature of 150° C. At this point, the vacuum pump and heater were interrupted and the sample was allowed to cool down to 25° C. Conductivity was calculated from the steady resistance value. The results are shown in Table 4.

TABLE 4

| Amine | Conducitivity (S/cm) |
|---|---|
| triphenylamine | $2.8 \times 10^{-4}$ |
| none (comparison) | $5.5 \times 10^{-6}$ |

According to the present invention, a silicon containing polymer having an amine compound admixed therewith is doped with an oxidizing dopant, typically iodine and ferric chloride, to produce a highly conductive polymer composition having improved shapability. The composition is easily applicable to form a highly conductive film or coating having improved shapability. It is a useful stock material which may find use in battery electrodes, solar battery and electromagnetic shield casings and the like.

Japanese Patent Application No. 6-23135 is incorporated herein by reference.

Although some preferred embodiments have been described, many modifications and variations may be made thereto in the light of the above teachings. It is therefore to be understood that within the scope of the appended claims, the invention may be practiced otherwise than as specifically described.

We claim:

1. A conductive polymer composition comprising a silicon containing polymer in admixture with an amine compound, the silicon containing polymer being doped with an oxidizing dopant, wherein the oxidizing dopant is iodine or ferric chloride.

2. The composition of claim 1 wherein the silicon containing polymer has a Si—Si bond or a Si—Si bond and a C—C multiple bond in its backbone.

3. The composition of claim 1 wherein the silicon containing polymer is selected from the group consisting of a polysilane, a poly(disilanylenephenylene), and a poly(disilanyleneethynylene).

4. The composition of claim 3 wherein the silicon containing polymer is selected from the group consisting of the compounds represented by the following formulae (1) to (3):

$$(R^1R^2Si)_n \quad (1)$$

$$(R^1R^2Si)_n(R^3R^4Si)_m \quad (2)$$

$$[(R^1R^2Si)—A—(R^3R^4Si)]_m \quad (3)$$

wherein $R^1$ to $R^4$ are independently a hydrogen atom or a substituted or unsubstituted monovalent hydrocarbon group having 1 to 14 carbon atoms, A is an ortho- , meta- or para-substituted phenylene group, an acetylene group or a linkage of a plurality of such groups, letter n is an integer of at least 2, and m is an integer of at least 1.

5. The composition of claim 4 wherein the silicon containing polymer has a number average molecular weight of 300 to 30,000,000.

6. The composition of claim 1 wherein the amine compound is selected from the group consisting of the compounds represented by the following formulae (4) and (5):

$$NR^5R^6R^7 \quad (4)$$

$$R^8R^9N—R^{10}—NR^{11}R^{12} \quad (5)$$

wherein $R^5$ to $R^9$, $R^{11}$, and $R^{12}$ are independently a hydrogen atom or a monovalent organic group having 1 to 24 carbon atoms, and $R^{10}$ is a divalent hydrocarbon group having 1 to 24 carbon atoms.

7. The composition of claim 6 wherein the amine compound is a tertiary amine compound.

8. The composition of claim 7 wherein the tertiary amine contains an aromatic ring.

9. The composition of claim 8 wherein the tertiary amine is triphenyl amine.

10. The composition of claim 1 wherein the amine compound is one represented by the following formulae:

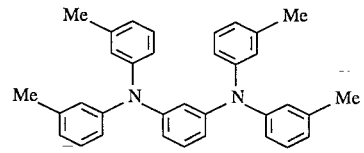

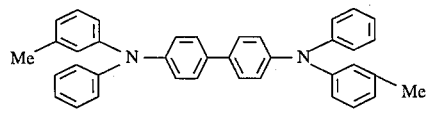

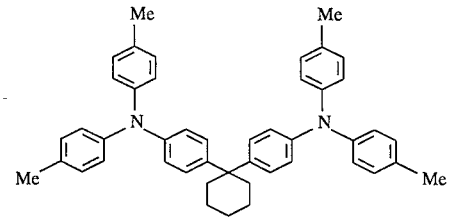

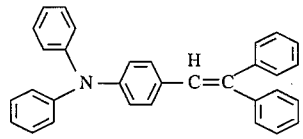

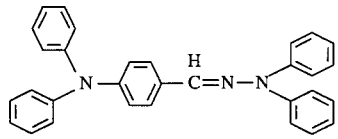

11. The composition of claim 1 wherein the amount of the amine compound blended in the composition is such that about 1 to 200 parts by weight of the amine compound is present per 100 parts by weight of the silicon containing polymer.

* * * * *